US006945732B2

(12) United States Patent
Renick

(10) Patent No.: US 6,945,732 B2
(45) Date of Patent: Sep. 20, 2005

(54) FLANGED ROAD MAT AND METHOD AND APPARATUS FOR ASSEMBLING SAME

(75) Inventor: Michael Renick, Village Mills, TX (US)

(73) Assignee: Streamline Production Company, Inc., Kountze, TX (US)

( * ) Notice: Subject to any disclaimer, the term of this patent is extended or adjusted under 35 U.S.C. 154(b) by 0 days.

(21) Appl. No.: 10/405,776

(22) Filed: Apr. 1, 2003

(65) Prior Publication Data

US 2004/0037644 A1 Feb. 26, 2004

Related U.S. Application Data

(63) Continuation-in-part of application No. 09/782,781, filed on Feb. 13, 2001, now abandoned.

(51) Int. Cl.[7] ..... E01C 9/08
(52) U.S. Cl. ..... 404/35
(58) Field of Search ..... 404/34, 35, 41; 14/2.4

(56) References Cited

U.S. PATENT DOCUMENTS

| | | | | | |
|---|---|---|---|---|---|
| 1,670,678 | A | * | 5/1928 | Cowper | 404/32 |
| 4,875,800 | A | * | 10/1989 | Hicks | 404/35 |
| 4,973,193 | A | * | 11/1990 | Watson et al. | 404/35 |
| 5,032,037 | A | * | 7/1991 | Phillips et al. | 404/73 |
| 5,273,373 | A | * | 12/1993 | Pouyer | 404/35 |
| 6,652,183 | B2 | * | 11/2003 | Stasiewich et al. | 404/35 |

* cited by examiner

*Primary Examiner*—Gary S. Hartmann
(74) *Attorney, Agent, or Firm*—The Matthews Firm

(57) ABSTRACT

An overlapping flanged mat system for assembling the mat system for fabricating an artificial road including parallel upper surface boards extending longitudinally in one array, an intermediate plurality of surface boards transverse to the upper layer, and a lower set of boards extending parallel to the upper boards, said lower set having an inner-connecting section, extending outwardly from the longitudinal position of the first and second set of boards, creating a landing surface. The mats are inner-connected by laying down a succession of such three-ply mats to form an artificial road.

3 Claims, 3 Drawing Sheets

FLANGED ROAD MAT AND METHOD AND APPARATUS FOR ASSEMBLING SAME

RELATED APPLICATIONS

This application is a continuation-in-part of U.S. patent application Ser. No. 09/782,781, filed Feb. 13, 2001.

BACKGROUND OF THE INVENTION

This invention relates to a new and improved three-ply inner connecting method and apparatus for a board road system and the mat which is used to form the board road. In the oil field and other areas, it is often necessary to lay down a temporary road. However, it should be understood that the road of the present invention can form a bed or an intermediate bed of a road. This bed can be covered over with asphalt or shell and become more than temporary.

The present system prevents heavy equipment trucks from sinking or becoming stuck and prevents tearing upheaval or unwanted damage of different soils.

There are several different board road patents which have supplanted or taken the place of work crews for laying down board roads. The reason is that a mat system can be dropped quickly and effectively and picked up and reused again and is actually more stable and cost-effective than ordinary crew installed board road systems.

DETAILED DESCRIPTION OF DRAWINGS

DETAILED DESCRIPTION OF THE PREFERRED EMBODIMENT

Figure 1:
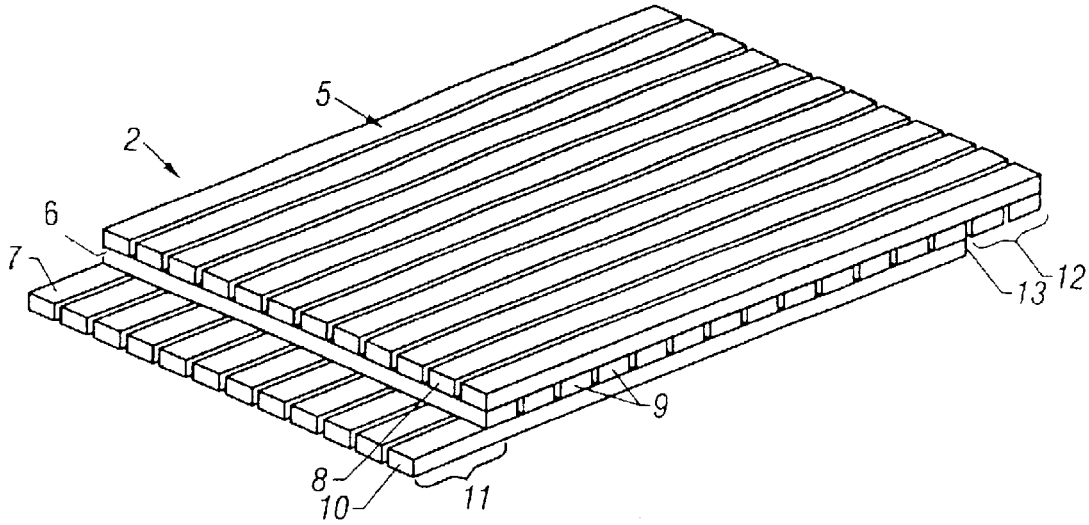
FIG. 1 is a view of one mat of the proposed flanged mat system.

As illustrated in FIG. 1, a mat 2, for forming a board road, may be laid out in an end-to-end relationship with each of the mats. The mat 2 is comprised of an upper section 5, intermediate section 6, and lower section 7. While such sections 5 and 7 are indicated as being upper and lower, it should be understood that in forming overlapping board roads, the mat may be flipped over such that section 5 becomes the lower section and section 7 becomes the upper section so long as subsequently laid down mats also have sections 5 and 7 in the same upper/lower orientation.

The sections 5, 6, and 7 are each illustrated as being made of lumber. However, they may be made of any other type of material including but not limited to concrete, fiberglass, particularized rubber, various types of composition, rubber, or any other types of material which may be lighter, heavier, more flexible or less flexible. Sections 5, 6, and 7 are typically connected together by bolts, nails or other suitable type of fastner or other methods of attachment. It should be understood that various materials for construction may require suitable ways of connection such as but not limited glue, welding, rivets and the like.

Each section, 5, 6, and 7, contains a plurality of boards 8, 9, and 10, respectively. Sections 5 and 7 have boards positioned parallel to and substantially side by side to each other. As illustrated, sections 5 and 7 are the same width (W) and same length (L), but are offset longitudinally relative to each other. Thus, section 7 has a section or portion forming an inner-connection or connection extension 11 and sections 5 and 6 form an inner-connection gap 12 which extends past end 13 of section 7.

Figure 2:
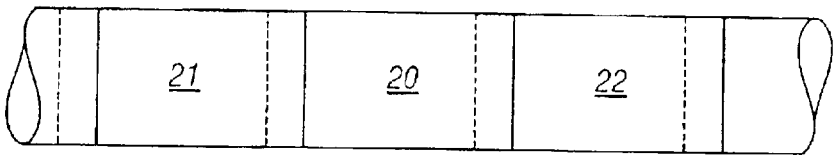
FIG. 2 is a top view of a series of mats connected longitudinally.
Figure 3:
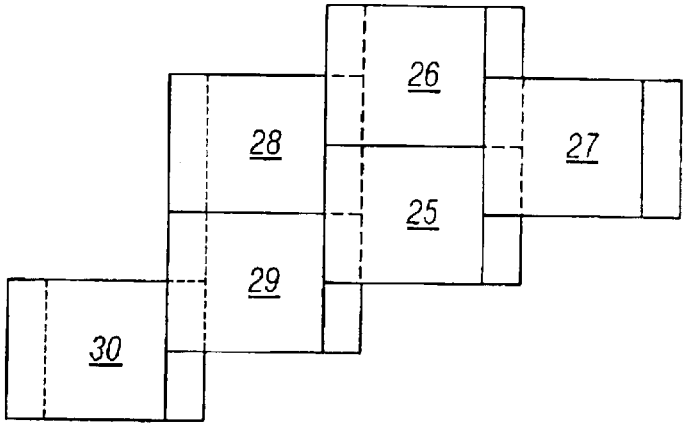
FIG. 3 is a top view of a series of mats connected longitudinally and laterally.

As further illustrated, section 6 forms the intermediate ply or section and contains a plurality of boards 9 which extend transverse to boards 8 and 10 of sections 5 and 7 respectively. Section 6 is of the same width and length (W and L) of section 5. Thus when attached together, sections 5 and 6 are of the same width and length (W and L); thereby making sections 5 and 6 the same length and width (W and L) as section 7. Together sections 5 and 6 form an overlap on one end with section 7 and a gap on the other end to form the inner-connecting end 11 and inner-connecting gap 12, as set forth herein above. FIG. 2 shows mats 20, 21, and 22 laid out to form a longitudinally extending board road as desired. FIG. 3 shows one simple example of an array of mats laid out to form a staging area, a mat system for a turn around, or a delivery area for various trucks. As illustrated in FIG. 3, mats 25, 26, 27, 28, 29, and 30, can be laid out in various arrays for forming squares, rectangles, or any various other configuration.

Figure 4:
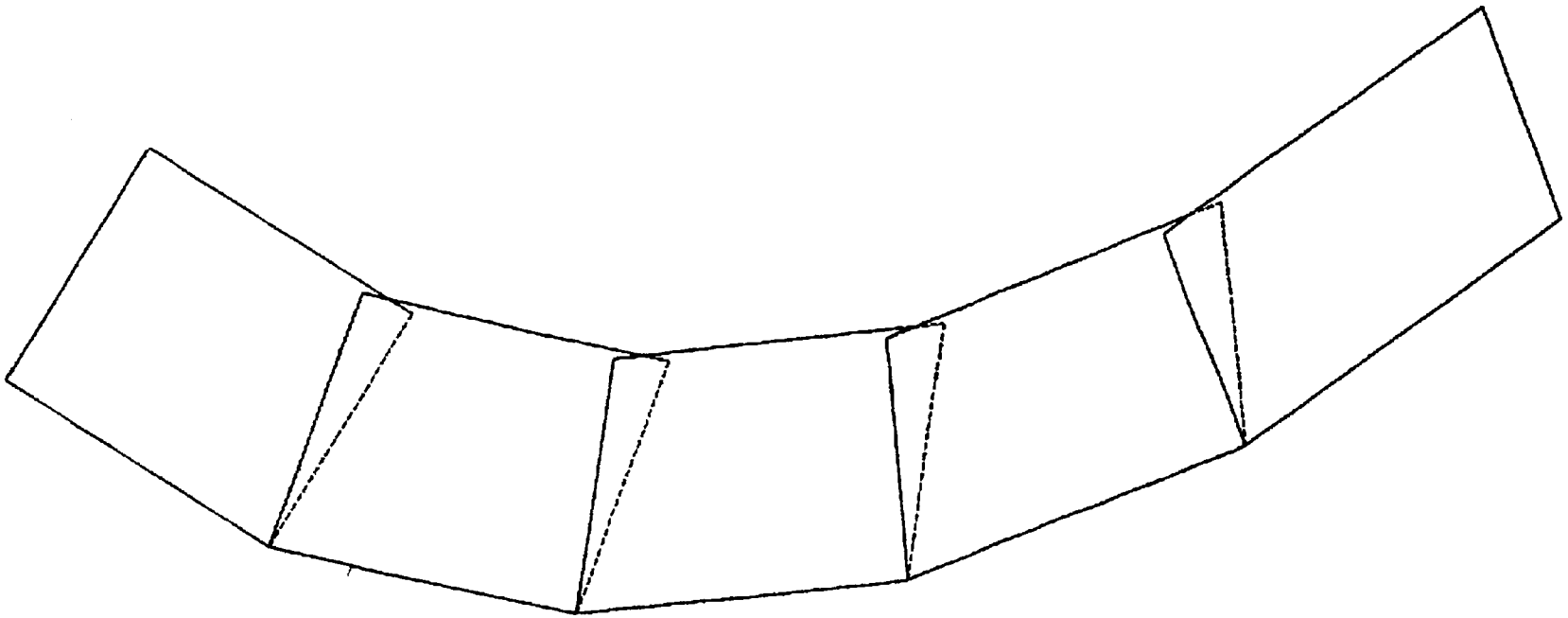
FIG. 4 is a top view of a series of mats connected longitudinally and rotated to build a curved road.

FIG. 4 illustrates another embodiment for the overlapping mat system. The individual mats can be rotated approximately 15 degrees and still retain the necessary strength and support characeristics regarding the over-lapping ends; thus preventing any damage to the over-lapping ends. This rotation allows for the building of curved road which can be constructed around obstacles and utilize fewer mats when constructing a turn.

Figure 5:
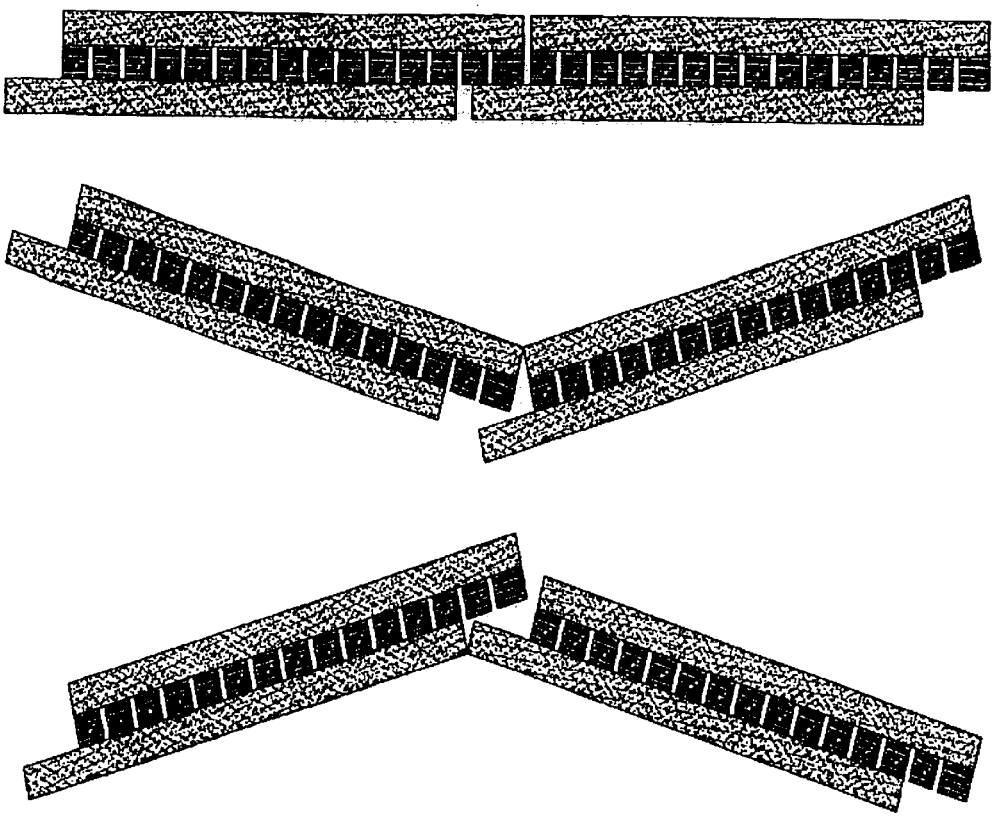
FIG. 5 is a side view illustrating the pivoting capability of the overlapping flanged mats.

FIG. 5 illustrates an important inherant feature of the overlapping mat system. The individual mats are capable of pivoting up and down without damage. The inter-connecting ends 11 and interconnecting-gaps 12 are not constrained by any tabs or lips and are thus free to move with respect to one another. The pivoting can be caused by a truck or other heavy equipment as it crosses the inter-connected sections 11, 12 of the mats 2.

The foregoing disclosure and description of the invention is illustrative and explanatory thereof, and it will be appreciated by those skilled in the art, that various changes in the size, shape and materials, the use of mechanical equivalents, as well as in the details of the illustrated construction or combinations of features of the various coring elements may be made without departing from the spirit of the invention.

What is claimed is:

1. A mat for forming a road, comprising:

a first section, a second section, and a third section; said second section being positioned between said first and third sections, said first, second, and third sections each being formed of a plurality of parallel boards of the same width and length (W and L), said second section having a plurality of parallel boards transverse to the boards of said first and third sections;

said first section having first and second end surfaces and first and second side surfaces, wherein each of the end surfaces of said first section corresponds to the longitudinal ends of said boards and each of the side surfaces of said first section corresponds to the longitudinal sides of said boards;

said second section having first and second end surfaces and first and second side surfaces, wherein each of the end surfaces of said second section correspond to the longitudinal ends of said boards and each of the side surfaces of said second section correspond to the longitudinal sides of said boards;

said third section having first and second end surfaces and first and second side surfaces, wherein each of the end surfaces of said third section correspond to the longitudinal ends of said boards and each of the side surfaces of said third section correspond to the longitudinal sides of said boards;

said first and second end surfaces of said first section being co-extensive with said first and second side surfaces of said second section and said first and second side surfaces of said first section being co-extensive with said first and second end surfaces of said second section;

the co-extensive first section end surfaces and the second section side surfaces being longitudinally offset from said third section end surfaces, respectfully;

a first portion of the co-extensive first section side surfaces and the second section end surfaces being co-extensive with said first and second side surfaces of said third section; and a second portion of the co-extensive first section side surfaces and the second section end surfaces being non-co-extensive with said first and second side surfaces of said third section.

2. A mat system for forming a road including at least two mats according to claim 1, wherein succeeding mats, inner-connected with each other, form a board road, and wherein said mats are offset to form a curved road.

3. The mat system according to claim 2, wherein the inner-connection of the succeeding mats allow the road to move upwardly or downwardly without damaging the inner-connections between the mats.

* * * * *